US009567915B2

(12) United States Patent
Hattar et al.

(10) Patent No.: US 9,567,915 B2
(45) Date of Patent: Feb. 14, 2017

(54) SYSTEM AND METHOD FOR CONTROLLING A LOW PRESSURE PUMP TO PREVENT VAPORIZATION OF FUEL AT AN INLET OF A HIGH PRESSURE PUMP

(71) Applicant: GM GLOBAL TECHNOLOGY OPERATIONS LLC, Detroit, MI (US)

(72) Inventors: Rafat F. Hattar, Royal Oak, MI (US); Brian L. O'Hear, Sterling Heights, MI (US); Phillip J. Baranek, Sterling Heights, MI (US); Richard R. Shippy, Flint, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 997 days.

(21) Appl. No.: 13/788,317

(22) Filed: Mar. 7, 2013

(65) Prior Publication Data

US 2014/0251269 A1 Sep. 11, 2014

(51) Int. Cl.

| | |
|---|---|
| ***F02D 1/00*** | (2006.01) |
| ***F02D 1/02*** | (2006.01) |
| ***F02M 37/00*** | (2006.01) |
| ***F02M 37/20*** | (2006.01) |
| ***F02D 41/18*** | (2006.01) |
| ***F02D 41/38*** | (2006.01) |
| *F02M 59/36* | (2006.01) |
| *F02D 41/30* | (2006.01) |

(52) U.S. Cl.

CPC ..... *F02D 1/02* (2013.01); *F02D 41/18* (2013.01); *F02D 41/3854* (2013.01); *F02M 37/0058* (2013.01); *F02M 37/20* (2013.01); *F02D 41/3082* (2013.01); *F02D 2200/021* (2013.01); *F02D 2200/0414* (2013.01); *F02D 2200/0602* (2013.01); *F02D 2200/0608* (2013.01); *F02D 2250/02* (2013.01); *F02M 59/366* (2013.01)

(58) Field of Classification Search

CPC ..... F02D 1/02; F02D 41/15; F02D 41/3854; F02D 41/3082; F02D 2200/021; F02D 2200/0414; F02D 2200/0602; F02D 2200/0608; F02D 2250/02; F02M 37/0058; F02M 37/20; F02M 59/366

See application file for complete search history.

(56) References Cited

U.S. PATENT DOCUMENTS 4,718,827 A * 1/1988 Sutton ..... F02M 37/08 29/464
5,755,211 A * 5/1998 Koch ..... F02D 19/0647 123/525

(Continued)

FOREIGN PATENT DOCUMENTS

JP 2010196534 A 9/2010

*Primary Examiner* — Hieu T Vo
*Assistant Examiner* — Sherman Manley

(57) ABSTRACT

A system according to the principles of the present disclosure includes a pump control module and a fuel vaporization module. The pump control module controls a first pump to deliver fuel from a fuel tank to a second pump through a fuel line. The pump control module controls the second pump to pressurize fuel from the fuel line and to deliver the pressurized fuel to a fuel rail. The fuel vaporization module determines whether fuel at an inlet of the second pump is vaporizing based on an engine operating condition. The pump control module increases an output of the first pump when fuel at the inlet of the second pump is vaporizing.

20 Claims, 5 Drawing Sheets

(56) References Cited

U.S. PATENT DOCUMENTS

| | | | | |
|---|---|---|---|---|
| 6,708,671 | B1 * | 3/2004 | Joos | F02D 41/1401 123/464 |
| 6,748,923 | B2 * | 6/2004 | Grossner | F02M 37/0029 123/446 |
| 8,793,059 | B2 * | 7/2014 | Albrecht | F02D 41/3854 123/447 |
| 2006/0225706 | A1 * | 10/2006 | Eser | F02D 41/3082 123/457 |
| 2007/0006849 | A1 * | 1/2007 | Mashiki | F02D 41/406 123/457 |
| 2008/0072880 | A1 * | 3/2008 | Wachtendorf | F02D 41/2464 123/495 |
| 2011/0106393 | A1 * | 5/2011 | Pursifull | F02D 33/003 701/101 |
| 2012/0143475 | A1 * | 6/2012 | Ryoo | F02D 41/065 701/103 |

* cited by examiner

SYSTEM AND METHOD FOR CONTROLLING A LOW PRESSURE PUMP TO PREVENT VAPORIZATION OF FUEL AT AN INLET OF A HIGH PRESSURE PUMP

FIELD

The present disclosure relates to internal combustion engines, and more specifically, to systems and methods for controlling a low pressure pump to prevent vaporization of fuel at an inlet of a high pressure pump.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

SUMMARY

A system according to the principles of the present disclosure includes a pump control module and a fuel vaporization module. The pump control module controls a first pump to deliver fuel from a fuel tank to a second pump through a fuel line. The pump control module controls the second pump to pressurize fuel from the fuel line and to deliver the pressurized fuel to a fuel rail. The fuel vaporization module determines whether fuel at an inlet of the second pump is vaporizing based on an engine operating condition. The pump control module increases an output of the first pump when fuel at the inlet of the second pump is vaporizing.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A fuel system of an engine such as a spark ignition direct injection (SIDI) engine may include a fuel tank, a low pressure pump, a high pressure pump, a fuel rail, and one or more fuel injectors. The low pressure pump may be an electric pump and may deliver fuel from the fuel tank to the high pressure pump. The high pressure pump may be driven by the engine, may pressurize fuel, and may deliver the pressurized fuel to the fuel rail. The fuel rail may distribute the pressurized fuel to the fuel injectors.

Fuel at the inlet of the high pressure pump may vaporize due to the pressure and the temperature at the inlet of the high pressure pump. For example, fuel at the inlet of the high pressure pump may vaporize when fueling to one or more (e.g., all) cylinders of the engine is cutoff for an extended period (e.g., 7 minutes), which may occur when a vehicle is towing a trailer and travelling down a mountain. During a fuel cutoff, the flow rate of fuel through the high pressure pump decreases, which increases the amount of heat transfer from the high pressure pump to fuel at the inlet of the high pressure pump. As a result, fuel at the inlet of the high pressure pump may vaporize.

Vapor formation at the inlet of the high pressure pump may cause engine stall, rough idle, hesitation in torque response, and/or poor drivability. In addition, vapor formation at the inlet of the high pressure pump may cause a diagnostic trouble code to be set. The diagnostic trouble code may falsely indicate a fault in the high pressure pump and/or a sensor that measures pressure in the fuel rail. In turn, the engine may be operated in a reduced power mode until the diagnostic trouble code is reset.

A system and method according to the present disclosure determines whether fuel at the inlet of the high pressure pump is vaporizing and increases the output of the low pressure pump when fuel at the inlet of the high pressure pump is vaporizing. Increasing the output of the low pressure pump increases the pressure at the inlet of the high pressure pump, which increases the boiling point of fuel at the inlet of the high pressure pump. The system and method may determine whether fuel at the inlet of the high pressure pump is vaporizing based on the temperature of the high pressure pump, the delivery duration of the high pressure pump, and/or the pressure within the fuel rail.

Figure 1:
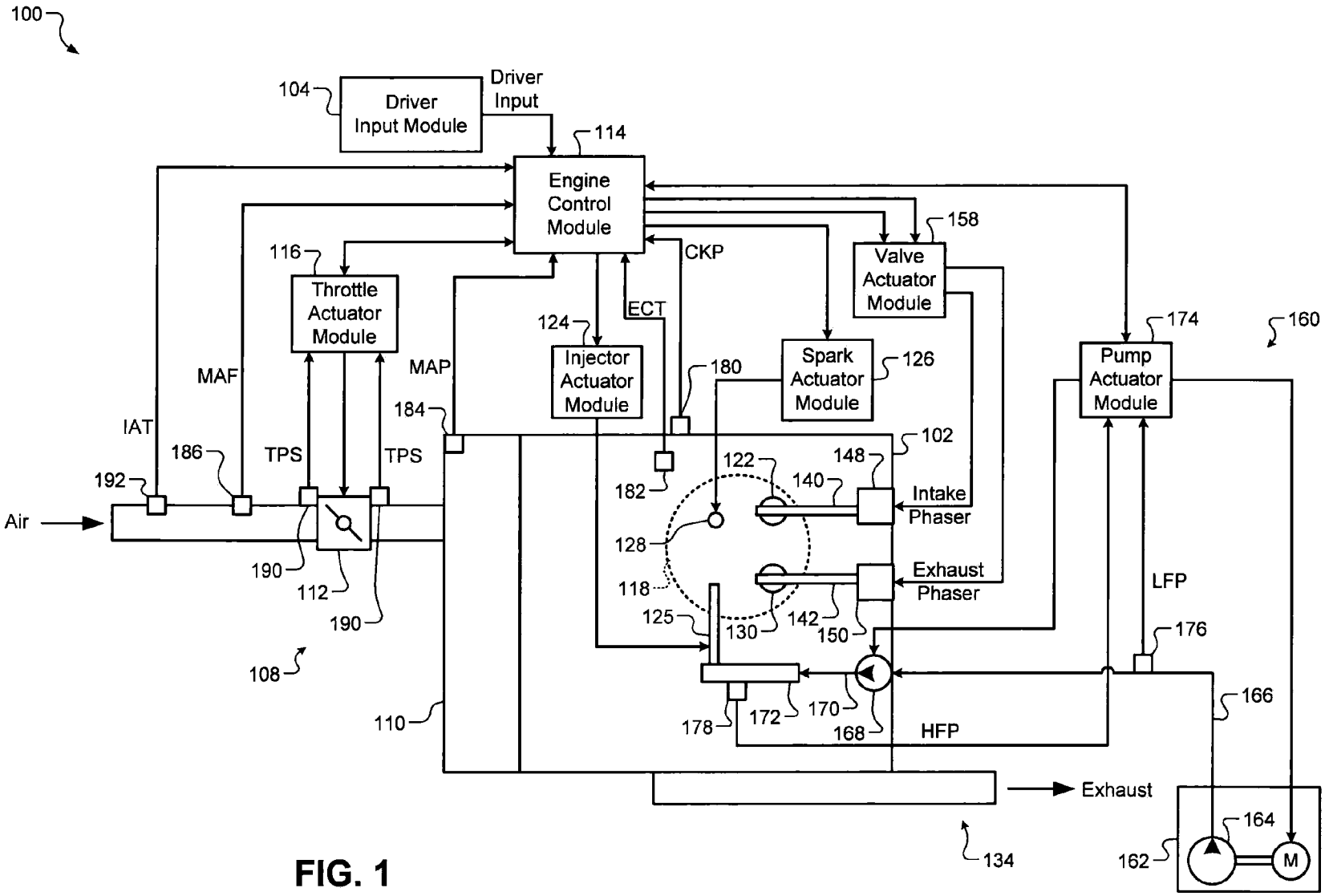
FIG. 1 is a functional block diagram of an example engine system according to the principles of the present disclosure.

Referring to FIG. 1, an example implementation of an engine system 100 includes an engine 102 that combusts an air/fuel mixture to produce drive torque for a vehicle. The engine 102 produces drive torque based on a driver input from a driver input module 104. The driver input may be based on a position of an accelerator pedal. The driver input may also be based on cruise control, which may be an adaptive cruise control system that varies vehicle speed to maintain a predetermined following distance.

Air is drawn into the engine 102 through an intake system 108. The intake system 108 includes an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls an injector actuator module 124, which regulates an opening duration of a fuel injector 125 to achieve a desired air/fuel ratio. Fuel may be injected into the intake manifold 110 at a central location or at multiple locations, such as near the intake valve 122 of each of the cylinders. The fuel injector 125 may inject fuel directly into the cylinders, as shown, or into mixing chambers associated with the cylinders. The injector actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. If the engine 102 includes multiple cylinders, the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A valve actuator module 158 may control the intake cam phaser 148 and the exhaust cam phaser 150 based on signals from the ECM 114. When implemented, variable valve lift may also be controlled by the valve actuator module 158.

The valve actuator module 158 may deactivate the cylinder 118 by disabling opening of the intake valve 122 and/or the exhaust valve 130. The valve actuator module 158 may disable opening of the intake valve 122 and the exhaust valve 130 by decoupling the intake valve 122 and the exhaust valve 130 from the intake camshaft 140 and the exhaust camshaft 142, respectively. In various implementations, the intake valve 122 and/or the exhaust valve 130 may be controlled by devices other than camshafts, such as electrohydraulic and/or electromagnetic actuators.

A fuel system 160 provides fuel to the fuel injector 125 for delivery to the cylinders. The fuel system 160 includes a fuel tank 162, a low pressure pump 164, a first fuel line 166, a high pressure pump 168, a second fuel line 170, and a fuel rail 172. The low pressure pump 164 delivers fuel from the fuel tank 162 to the high pressure pump 168 through the first fuel line 166. The low pressure pump 164 may be an electric pump.

The high pressure pump 168 pressurizes fuel from the first fuel line 166 and delivers the pressurized fuel to the fuel rail 172 through the second fuel line 170. The high pressure pump 168 may be driven by the intake camshaft 140 and/or the exhaust camshaft 142. The fuel rail 172 distributes the pressurized fuel to one or more fuel injectors of the engine 102, such as the fuel injector 125.

The ECM 114 controls a pump actuator module 174, which regulates the output of the low pressure pump 164 and the high pressure pump 168 to achieve a desired pressure in the first fuel line 166 and the fuel rail 172, respectively. A low side fuel pressure (LFP) sensor 176 measures the pressure of fuel in the first fuel line 166, which may be referred to as a low side pressure. A high side fuel pressure (HFP) sensor 178 measures the pressure of fuel in the fuel rail 172, which may be referred to as a high side pressure. The LFP sensor 176 and the HFP sensor 178 may provide the low side pressure and the high side pressure to the pump actuator module 174, which in turn may provide the low side pressure and the high side pressure to the ECM 114. Alternatively, the LFP sensor 176 and the HFP sensor 178 may provide the low side pressure and the high side pressure directly to the ECM 114.

The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

Figure 2:
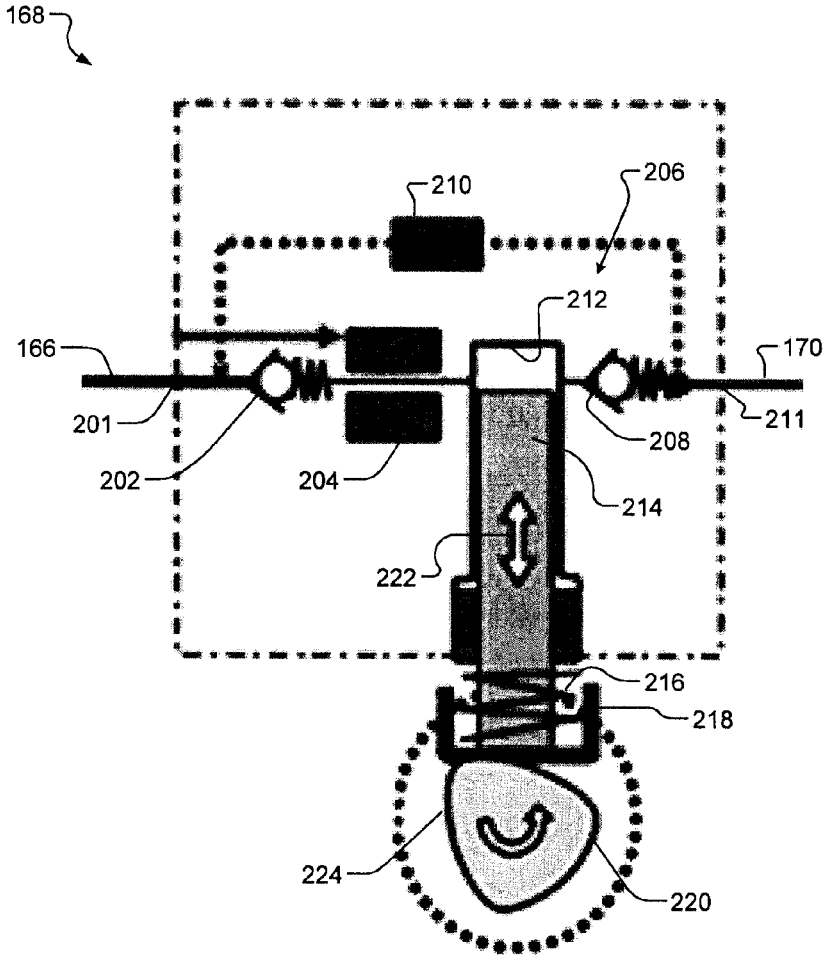
FIG. 2 is a schematic of a high pressure pump of the engine system of FIG. 1.

Referring to FIG. 2, an example implementation of the high pressure pump 168 includes an inlet 201, a first check valve 202, a solenoid valve 204, a pump mechanism 206, a second check valve 208, a relief valve 210, and an outlet 211. The check valves 202, 208 allow fuel flow in only one direction (i.e., the direction from the first fuel line 166 to the second fuel line 170). The solenoid valve 204 allows fuel flow from the first fuel line 166 to the second fuel line 170 when the solenoid valve 204 is open. The solenoid valve 204 prevents fuel flow from the first fuel line 166 to the second fuel line 170 when the solenoid valve 204 is closed. The solenoid valve 204 may open or close based on a signal received from the pump actuator module 174. The relief valve 210 may open to allow fuel flow from the second fuel line 170 to the first fuel line 166 when the pressure within the second fuel line 170 is greater than a predetermined pressure.

The pump mechanism 206 includes a chamber 212, a piston 214, a spring 216, a spring seat 218, and a camshaft 220 such as the intake camshaft 140 or the exhaust camshaft 142. The chamber 212 receives fuel from the first fuel line 166 when the solenoid valve 204 is open. The spring seat 218 engages the camshaft 220. The spring 216 transfers force from the spring seat 218 to the piston 214 and keeps the spring seat 218 engaged with the camshaft 220. Thus, as the intake camshaft 140 rotates, the piston 214 reciprocates within the chamber 212 in the directions indicated by double arrow 222. Relative to the orientation shown in FIG. 2, the piston 214 may move in an upward direction when the spring seat 218 engages a lobe 224 on the camshaft 220, which may force fuel from the chamber 212 to the second fuel line 170.

The pump actuator module 174 may adjust the opening duration of the solenoid valve 204 to adjust the output of the high pressure pump 168. The spring seat 218 engages the lobe 224 for a predetermined amount of crankshaft rotation (e.g., 130 degrees), which is governed by the shape of the lobe 224. The pump actuator module 174 may open the solenoid valve 204 when the spring seat 218 engages the lobe 224. The pump actuator module 174 may operate the high pressure pump 168 at full capacity by opening the solenoid valve 204 for the entire period that the spring seat 218 engages the lobe 224. The pump actuator module 174 may operate the high pressure pump 168 at a capacity that is less than full capacity by opening the solenoid valve 204 for a portion of the period that the spring seat 218 engages the lobe 224. The pump actuator module 174 may determine when the spring seat 218 engages the lobe 224 based on the crankshaft position.

Figure 3:
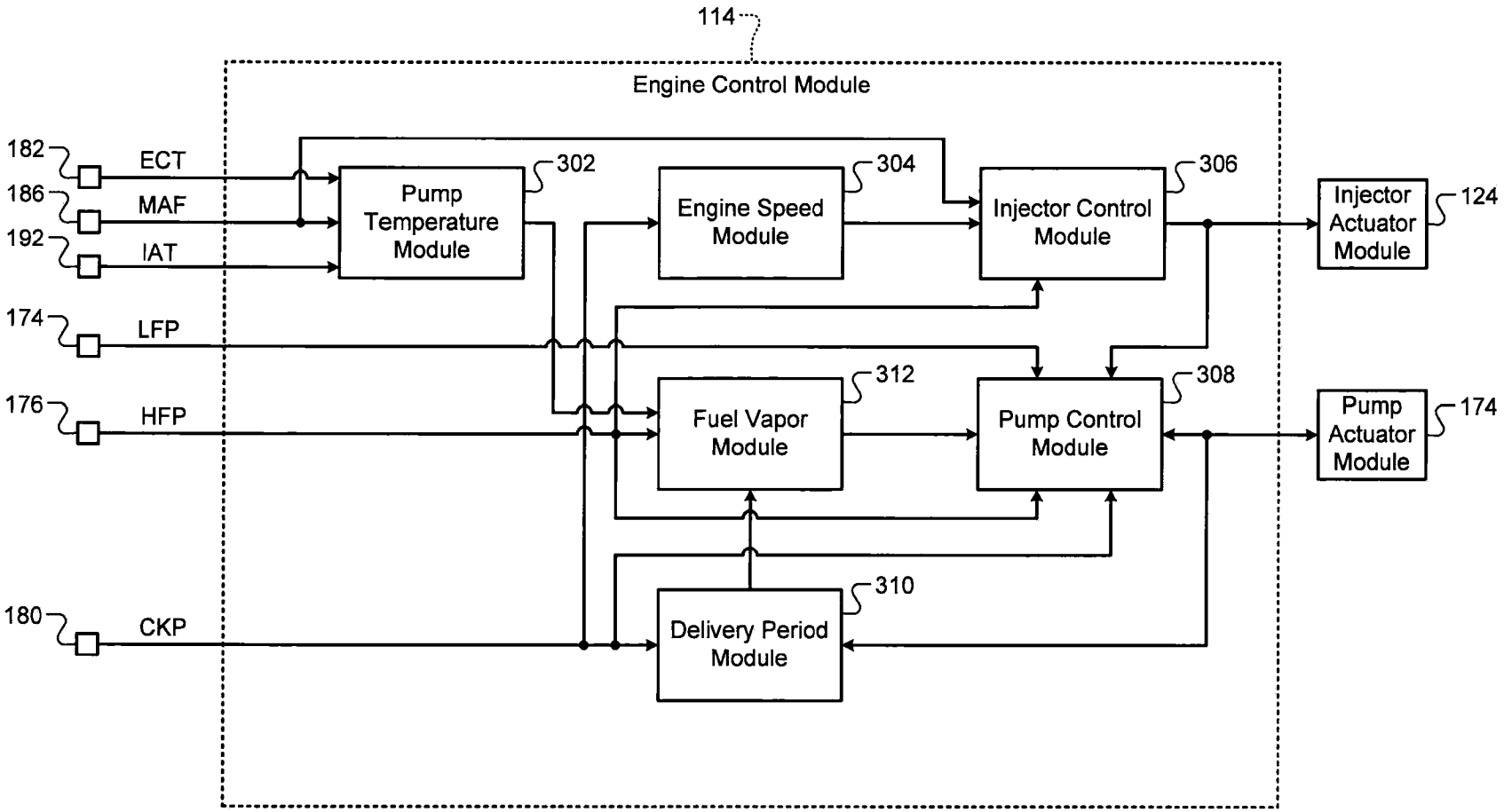
FIG. 3 is a functional block diagram of an example control system according to the principles of the present disclosure.

Referring to FIG. 3, an example implementation of the ECM 114 includes a pump temperature module 302, an engine speed module 304, an injector control module 306, a pump control module 308, a delivery period module 310, and a fuel vaporization module 312. The pump temperature module 302 determines the temperature of the high pressure pump 168. The pump temperature module 302 may estimate the temperature of the high pressure pump 168 based on the engine coolant temperature, the mass flow rate of intake air, and/or the intake air temperature.

The pump temperature module 302 may estimate the temperature (T) of the high pressure pump 168 based on a relationship such as $$T=f(WF1*IAT+WF2*ECT), \quad (1)$$

where WF1 is a first weighting factor, IAT is the intake air temperature, WF2 is a second weighting factor, and ECT is the engine coolant temperature. The first weighting factor may be directly proportional to the mass flow rate of intake air, and the second weighting factor may be inversely proportional to the mass flow rate of intake air. For example, the first weighting factor and the second weighting factor may each be 0.5 when the mass flow rate of intake air is 32 grams per second (g/s). In another example, the first weighting factor may be 0.8 and the second weighting factor may be 0.2 when the mass flow rate of intake air is 100 g/s.

The engine speed module 304 determines engine speed based on the crankshaft position from the CKP sensor 180. The engine speed module 304 may determine the engine speed based on an amount of crankshaft rotation between tooth detections and the corresponding period. The engine speed module 304 outputs the engine speed.

The injector control module 306 controls the injector actuator module 124 to adjust the opening duration of the fuel injector 125. The injector control module 306 may determine the opening duration of the fuel injector 125 based on a desired fueling rate and the high side pressure. The injector control module 306 may determine the desired fueling rate based on the desired air/fuel ratio and/or an amount of air per cylinder. The injector control module 306 may determine the amount of air per cylinder based on the mass flow rate of intake air and/or the engine speed.

The pump control module 308 controls the pump actuator module 174 to adjust the output of the low pressure pump 164 and the high pressure pump 168. The pump control module 308 may adjust the output of the low pressure pump 164 based on the measured low side pressure and a desired low side pressure. The pump control module 308 may adjust the output of the high pressure pump 168 based on the measured high side pressure and a desired high side pressure. The pump control module 308 may determine the desired low side pressure and/or the desired high side pressure based on the desired fueling rate.

The delivery period module 310 determines a period for which the high pressure pump 168 delivers fuel to the fuel rail 172, which may be referred to as a delivery period of the high pressure pump 168. The delivery period module 310 may determine an amount of crankshaft rotation that corresponds to the delivery period based on when the high pressure pump 168 is activated (e.g., when the solenoid valve 204 is open) and the crankshaft position. The delivery period module 310 may determine when the high pressure pump 168 is activated based on communication between the pump control module 308 and the pump actuator module 174.

The fuel vaporization module 312 determines whether fuel at the inlet of the high pressure pump 168 is vaporizing. The fuel vaporization module 312 may determine whether fuel at the inlet of the high pressure pump 168 is vaporizing based on the pump temperature, the high side pressure, and/or the delivery period of the high pressure pump 168. The fuel vaporization module 312 may generate a signal indicating whether fuel at the inlet of the high pressure pump 168 is vaporizing.

The fuel vaporization module 312 may determine that fuel at the inlet of the high pressure pump 168 is vaporizing when the pump temperature is greater than a first temperature (e.g., 60 degrees Celsius (° C.)). The fuel vaporization module 312 may determine that fuel at the inlet of the high pressure pump 168 is vaporizing when the high side pressure is less than a first pressure (e.g., 1 megapascal (MPa)). The fuel vaporization module 312 may determine that fuel at the inlet of the high pressure pump 168 is vaporizing when the amount of crankshaft rotation corresponding to the delivery period is greater than a first amount (e.g., 120 degrees). The first temperature, the first pressure, and/or the first amount may be predetermined.

The pump control module 308 may increase the output of the low pressure pump 164 when fuel at the inlet of the high pressure pump 168 is vaporizing. For example, the pump control module 308 may normally operate the low pressure pump 164 within a capacity range having an upper limit between 70 percent and 80 percent. However, when fuel at the inlet of the high pressure pump 168 is vaporizing, the pump control module 308 may increase the operating capacity of the low pressure pump 164 to a percentage that is greater than 80 percent (e.g., 100 percent). An operating capacity of 100 percent may be referred to as full capacity or maximum capacity.

The pump control module 308 may operate the low pressure pump 164 at the increased capacity for a predetermined period (e.g., from 1 second to 2 seconds). Additionally or alternatively, the pump control module 308 may operate the low pressure pump 164 at the increased capacity until the amount of crankshaft rotation corresponding to the delivery period is less than a second amount (e.g., 100 degrees). Additionally or alternatively, the pump control module 308 may operate the low pressure pump 164 at the increased capacity until the high side pressure is greater than a second pressure (e.g., 2 MPa). The second amount and/or the second pressure may be predetermined.

The pump control module 308 may adjust the operating capacity of the low pressure pump 164 by adjusting the desired low side pressure. For example, the pump control module 308 may normally maintain the desired low side pressure at approximately 320 kilopascals (kPa). However, when fuel at the inlet of the high pressure pump 168 is vaporizing, the pump control module 308 may increase the desired low side pressure to approximately 600 kPa.

Figure 4:
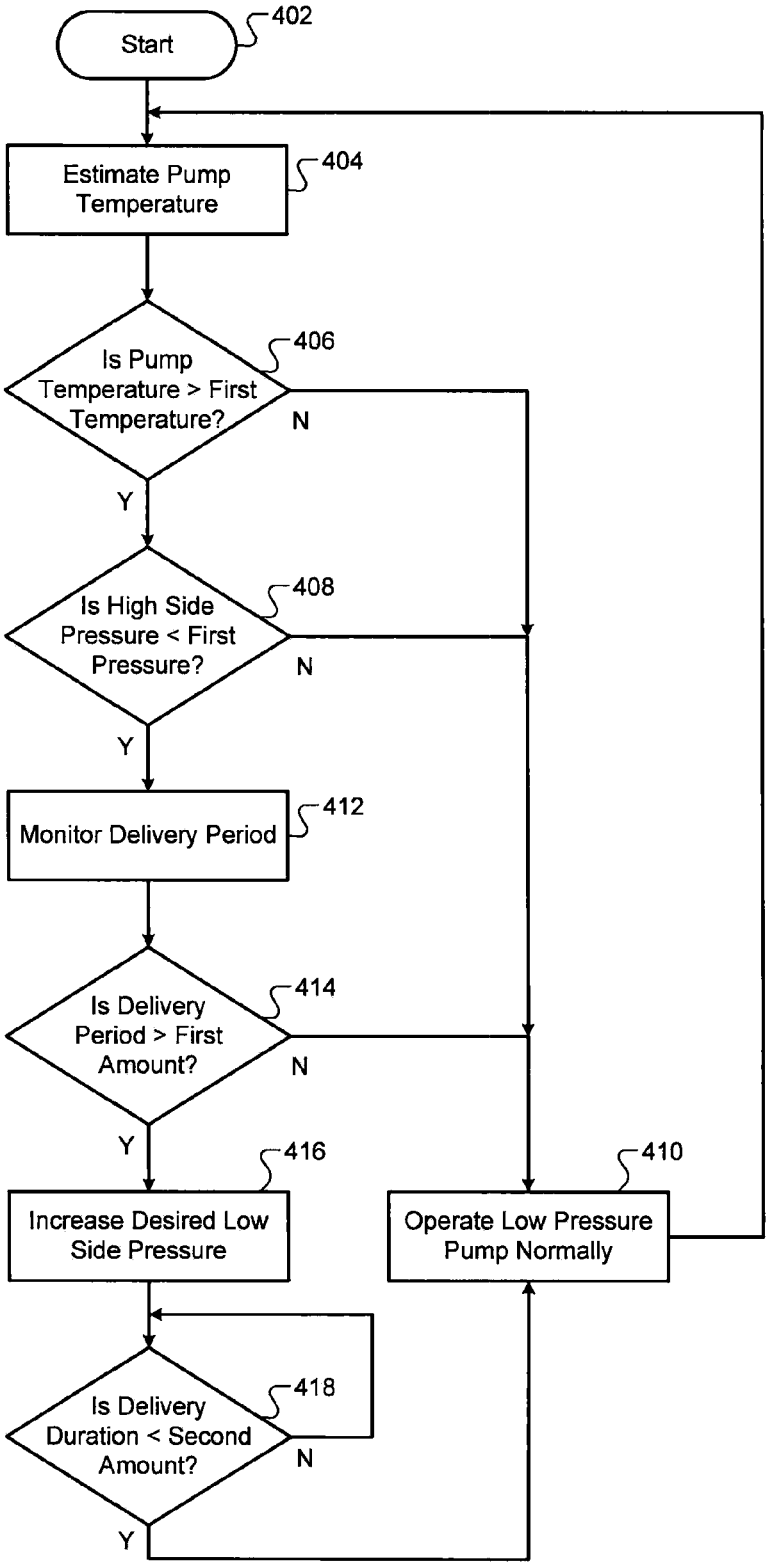
FIG. 4 is a flowchart illustrating an example control method according to the principles of the present disclosure.

Referring to FIG. 4, an example method for controlling a low pressure pump to prevent vapor formation at an inlet of a high pressure pump begins at 402. At 404, the method estimates the temperature of the high pressure pump. The method may estimate the temperature of the high pressure pump based on an engine coolant temperature, a mass flow rate of intake air, and/or an intake air temperature. For example, the method may estimate the temperature of the high pressure pump using a relationship such as relationship (1) discussed above with reference to FIG. 2. Relationship (1) may be embodied in a lookup table and/or an equation.

At 406, the method determines whether the pump temperature is greater than a first temperature (e.g., 60° C.). If the pump temperature is greater than the first temperature, the method continues to 408. Otherwise, the method continues to 410.

At 408, the method determines whether the pressure on the outlet side of the high pressure pump is less than a first pressure (e.g., 1 MPa). The pressure on the outlet side of the high pressure pump may be referred to as the high side pressure. The method may measure the high side pressure in a fuel rail and/or in a fuel line extending from the high pressure pump to the fuel rail. If the high side pressure is less than the first pressure, the method continues to 412. Otherwise, the method continues to 410.

At 410, the method operates the low pressure pump normally. For example, the method may operate the low pressure pump within a capacity range having an upper limit between 70 percent and 80 percent. Additionally or alternatively, the method may maintain a desired pressure on the outlet side of the low pressure pump at approximately 320 kPa. The pressure on the outlet side of the low pressure pump may be referred to as the low side pressure.

At 412, the method monitors a period for which the high pressure pump delivers fuel to the fuel rail, which may be referred to as a delivery period of the high pressure pump. The method may determine an amount of crankshaft rotation that corresponds to the delivery period based on when the high pressure pump is activated (e.g., when a solenoid valve in the high pressure pump is open) and a measured crankshaft position. The method may adjust the delivery period based on a difference between a desired high side pressure and a measured high side pressure.

At 414, the method determines whether the amount of crankshaft rotation corresponding to the delivery period is greater than a first amount (e.g., 120 degrees). If the amount of crankshaft rotation corresponding to the delivery period is greater than the first amount, the method continues at 416. Otherwise, the method continues at 410.

At 416, the method increases the desired low side pressure. For example, the method may increase the desired low side pressure to approximately 600 kPa. Additionally or alternatively, the method may increase the operating capacity of the low pressure pump to a percentage that is greater than 80 percent (e.g., 100 percent).

At 418, the method determines whether the amount of crankshaft rotation corresponding to the delivery period is less than a second amount (e.g., 100 degrees). If the amount of crankshaft rotation corresponding to the delivery period is less than the second amount, the method continues at 410. Additionally or alternatively, at 418, the method may determine whether the period for which the low pressure pump is operated at the increased capacity is greater than a first period (e.g., from 1 second to 2 seconds). If the period for which the low pressure pump is operated at the increased capacity is greater than the first period, the method may continue at 410. Additionally or alternatively, at 418, the method may determine whether the high side pressure is greater than a second pressure (e.g., 2 MPa). If the high side pressure is greater than the second amount, the method continues at 410. The first temperature, the first pressure, the first amount, the second amount, the first period, and/or the second pressure may be predetermined.

Figure 5:
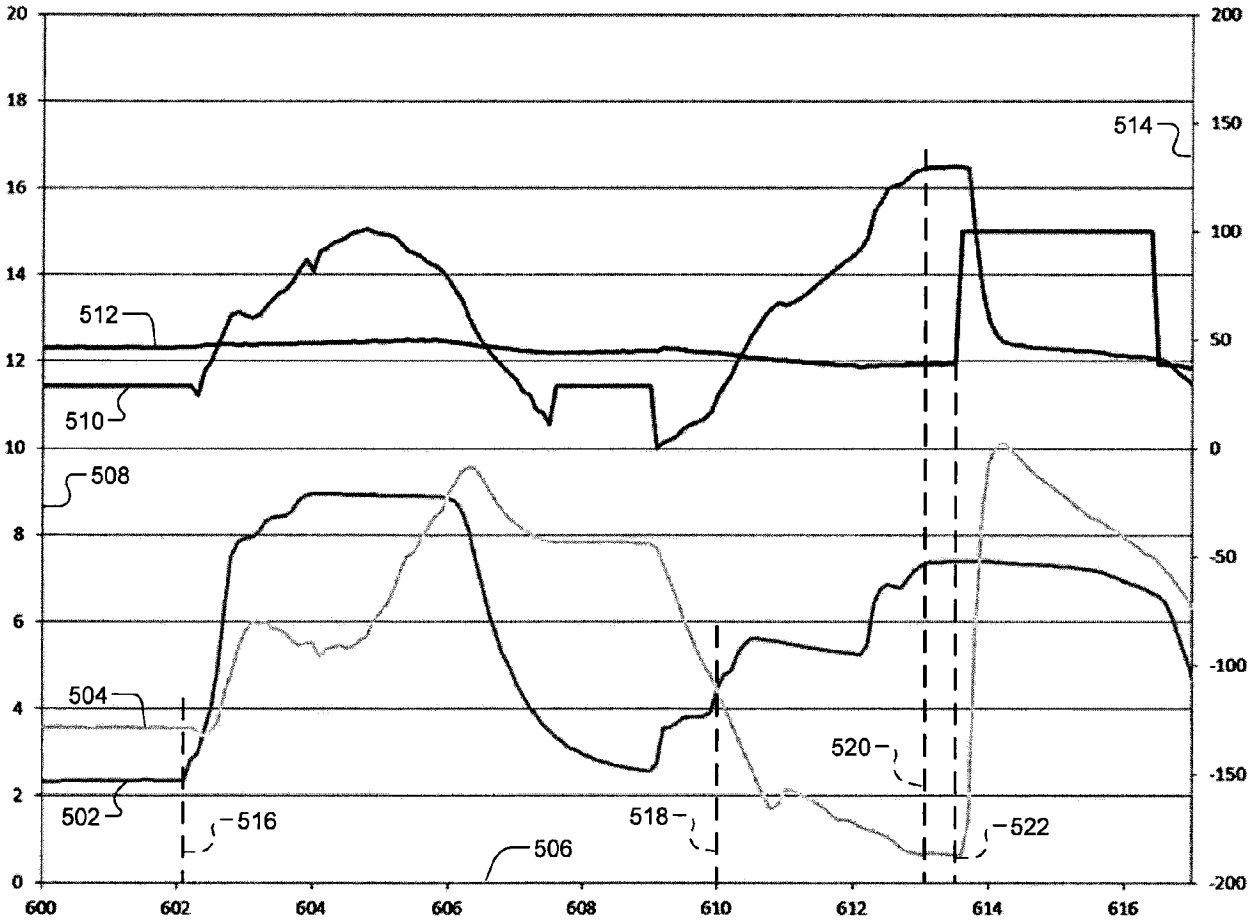
FIG. 5 is a graph illustrating example sensor signals and example control signals according to the principles of the present disclosure.

Referring to FIG. 5, a desired high side pressure 502 and a measured high side pressure 504 are plotted with respect to an x-axis 506 and a first y-axis 508. The x-axis 506 indicates time in seconds, and the first y-axis 508 indicates pressure in MPa. In addition, a delivery period 510 of a high pressure pump and a duty cycle 512 of a low pressure pump are plotted with respect to the x-axis 506 and a second y-axis 514. The second y-axis 514 indicates crankshaft rotation in degrees and duty cycle in percent.

At 516, the desired high side pressure increases, indicating that fuel delivery to cylinders of an engine is enabled after fuel delivery is cutoff. At 518, the measured high side pressure becomes less than the desired high side pressure. At 520, the delivery period 510 of the high pressure pump increases to a maximum value, indicating vapor formation at the inlet of the high pressure pump. At 522, a system and method according to the present disclosure increases the duty cycle 512 of the low pressure pump to 100 percent. As a result, the measured high side pressure 504 increases, indicating that vapor formation at the inlet of the high pressure pump is eliminated.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a pump control module that:

controls a first pump to deliver fuel from a fuel tank to a second pump through a fuel line; and controls the second pump to pressurize fuel from the fuel line and to deliver the pressurized fuel to a fuel rail; and a fuel vaporization module that determines whether fuel at an inlet of the second pump is vaporizing based on a pressure within the fuel rail and a period for which the second pump delivers fuel to the fuel rail, wherein the pump control module increases an output of the first pump when fuel at the inlet of the second pump is vaporizing.

2. The system of claim 1 wherein the pump control module increases the output of the first pump to full capacity when fuel at the inlet of the second pump is vaporizing.

3. The system of claim 1 wherein the fuel vaporization module determines whether fuel at the inlet of the second pump is vaporizing further based on a temperature of the second pump.

4. The system of claim 1 wherein the pump control module increases the output of the first pump when a temperature of the second pump is greater than a first temperature.

5. The system of claim 4 further comprising a pump temperature module that estimates the temperature of the second pump based on an inlet air temperature, an engine coolant temperature, and a mass flow rate of inlet air.

6. The system of claim 5 wherein the pump temperature module:

assigns a first weighting factor to the inlet air temperature based on the mass flow rate;

assigns a second weighting factor to the engine coolant temperature based on the mass flow rate; and estimates the temperature of the second pump based on the first weighting factor and the second weighting factor.

7. The system of claim 6 wherein:

the first weighting factor is directly proportional to the mass flow rate; and the second weighting factor is inversely proportional to the mass flow rate.

8. A system comprising:

a pump control module that:

controls a first pump to deliver fuel from a fuel tank to a second pump through a fuel line; and controls the second pump to pressurize fuel from the fuel line and to deliver the pressurized fuel to a fuel rail; and a fuel vaporization module that determines whether fuel at an inlet of the second pump is vaporizing based on an engine operating condition that includes at least one of a pressure within the fuel rail and a period for which the second pump delivers fuel to the fuel rail, wherein the pump control module increases an output of the first pump when fuel at the inlet of the second pump is vaporizing, and wherein the pump control module increases the output of the first pump when a pressure within the fuel rail is less than a first pressure.

9. A system comprising:

a pump control module that:

controls a first pump to deliver fuel from a fuel tank to a second pump through a fuel line; and controls the second pump to pressurize fuel from the fuel line and to deliver the pressurized fuel to a fuel rail for a period; and a fuel vaporization module that determines whether fuel at an inlet of the second pump is vaporizing based on an engine operating condition that includes at least one of a pressure within the fuel rail and a period for which the second pump delivers fuel to the fuel rail, wherein the pump control module increases an output of the first pump when fuel at the inlet of the second pump is vaporizing, and wherein the pump control module increases the output of the first pump when an amount of crankshaft rotation corresponding to the period is greater than a first amount.

10. The system of claim 9 wherein, after increasing the output of the first pump, the pump control module decreases the output of the first pump when at least one of:

the output of the first pump is increased for a predetermined period;

the amount of crankshaft rotation corresponding to the period is less than a second amount; and a pressure within the fuel rail is greater than a predetermined pressure.

11. A method comprising:

controlling a first pump to deliver fuel from a fuel tank to a second pump through a fuel line;

controlling the second pump to pressurize fuel from the fuel line and to deliver the pressurized fuel to a fuel rail;

determining whether fuel at an inlet of the second pump is vaporizing based on a pressure within the fuel rail and a period for which the second pump delivers fuel to the fuel rail; and increasing an output of the first pump when fuel at the inlet of the second pump is vaporizing.

12. The method of claim 11 further comprising increasing the output of the first pump to full capacity when fuel at the inlet of the second pump is vaporizing.

13. The method of claim 11 further comprising determining whether fuel at the inlet of the second pump is vaporizing further based on a temperature of the second pump.

14. The method of claim 11 further comprising increasing the output of the first pump when a temperature of the second pump is greater than a first temperature.

15. The method of claim 14 further comprising estimating the temperature of the second pump based on an inlet air temperature, an engine coolant temperature, and a mass flow rate of inlet air.

16. The method of claim 15 further comprising:

assigning a first weighting factor to the inlet air temperature based on the mass flow rate;

assigning a second weighting factor to the engine coolant temperature based on the mass flow rate; and estimating the temperature of the second pump based on the first weighting factor and the second weighting factor.

17. The method of claim 16 wherein:

the first weighting factor is directly proportional to the mass flow rate; and the second weighting factor is inversely proportional to the mass flow rate.

18. A method comprising:

controlling a first pump to deliver fuel from a fuel tank to a second pump through a fuel line;

controlling the second pump to pressurize fuel from the fuel line and to deliver the pressurized fuel to a fuel rail;

determining whether fuel at an inlet of the second pump is vaporizing based on an engine operating condition that includes at least one of a pressure within the fuel rail and a period for which the second pump delivers fuel to the fuel rail;

increasing an output of the first pump when fuel at the inlet of the second pump is vaporizing; and increasing the output of the first pump when a pressure within the fuel rail is less than a first pressure.

19. A method comprising:

controlling a first pump to deliver fuel from a fuel tank to a second pump through a fuel line;

controlling the second pump to pressurize fuel from the fuel line and to deliver the pressurized fuel to a fuel rail for a period;

determining whether fuel at an inlet of the second pump is vaporizing based on an engine operating condition that includes at least one of a pressure within the fuel rail and a period for which the second pump delivers fuel to the fuel rail;

increasing an output of the first pump when fuel at the inlet of the second pump is vaporizing; and increasing the output of the first pump when an amount of crankshaft rotation corresponding to the period is greater than a first amount.

20. The method of claim 19 further comprising, after increasing the output of the first pump, decreasing the output of the first pump when at least one of:

the output of the first pump is increased for a predetermined period;

the amount of crankshaft rotation corresponding to the period is less than a second amount; and a pressure within the fuel rail is greater than a predetermined pressure.

* * * * *